United States Patent [19]

Bolin

[11] 4,149,046

[45] Apr. 10, 1979

[54] ROTATIONAL LINE SWITCH CONTROL

[75] Inventor: Donald E. Bolin, Galveston, Ind.

[73] Assignee: The Scott & Fetzer Company, Kokomo, Ind.

[21] Appl. No.: 797,258

[22] Filed: May 16, 1977

[51] Int. Cl.[2] ..... H01H 43/00; G05G 1/08

[52] U.S. Cl. ..... 200/38 A; 74/504; 200/38 C; 200/38 E

[58] Field of Search ..... 64/16, 23, DIG. 2; 74/3.5, 3.52, 504; 200/37 R, 37 A, 38 R, 38 A, 38 B, 38 BA, 38 C, 38 CA, 153 V, 158, 38, 37, 153, 38 E, DIG. 42

[56] References Cited

U.S. PATENT DOCUMENTS

| | | | |
|---|---|---|---|
| 2,665,904 | 1/1954 | Lehmann | 74/504 X |
| 2,703,347 | 3/1955 | Constantine | 200/38 C X |
| 2,889,419 | 6/1959 | Miller et al. | 200/38 BA |
| 3,033,054 | 5/1962 | Woolley | 74/504 |
| 3,159,255 | 12/1964 | Woolley | 200/38 R X |
| 3,190,418 | 6/1965 | Woolley | 74/3.5 X |
| 3,227,826 | 1/1966 | Beare | 74/504 X |
| 3,388,602 | 6/1968 | Shopsky | 200/38 C X |
| 3,603,749 | 9/1971 | Davis | 200/37 A X |
| 3,866,002 | 2/1975 | Underwood et al. | 200/38 B X |

*Primary Examiner*—James R. Scott

*Attorney, Agent, or Firm*—McNenny, Pearne, Gordon, Gail, Dickinson & Schiller

[57] ABSTRACT

A control mechanism for a sequential timer is disclosed. The mechanism includes an axially movable timer shaft which is associated with a timer shaft extension or control knob in such a way that initial movement of the control knob to select a particular position on the timing cycle will axially move the timer shaft to open a circuit in the timer. The open circuit prevents arcing of switch contacts and short pulsing of current through solenoids and motors.

8 Claims, 3 Drawing Figures

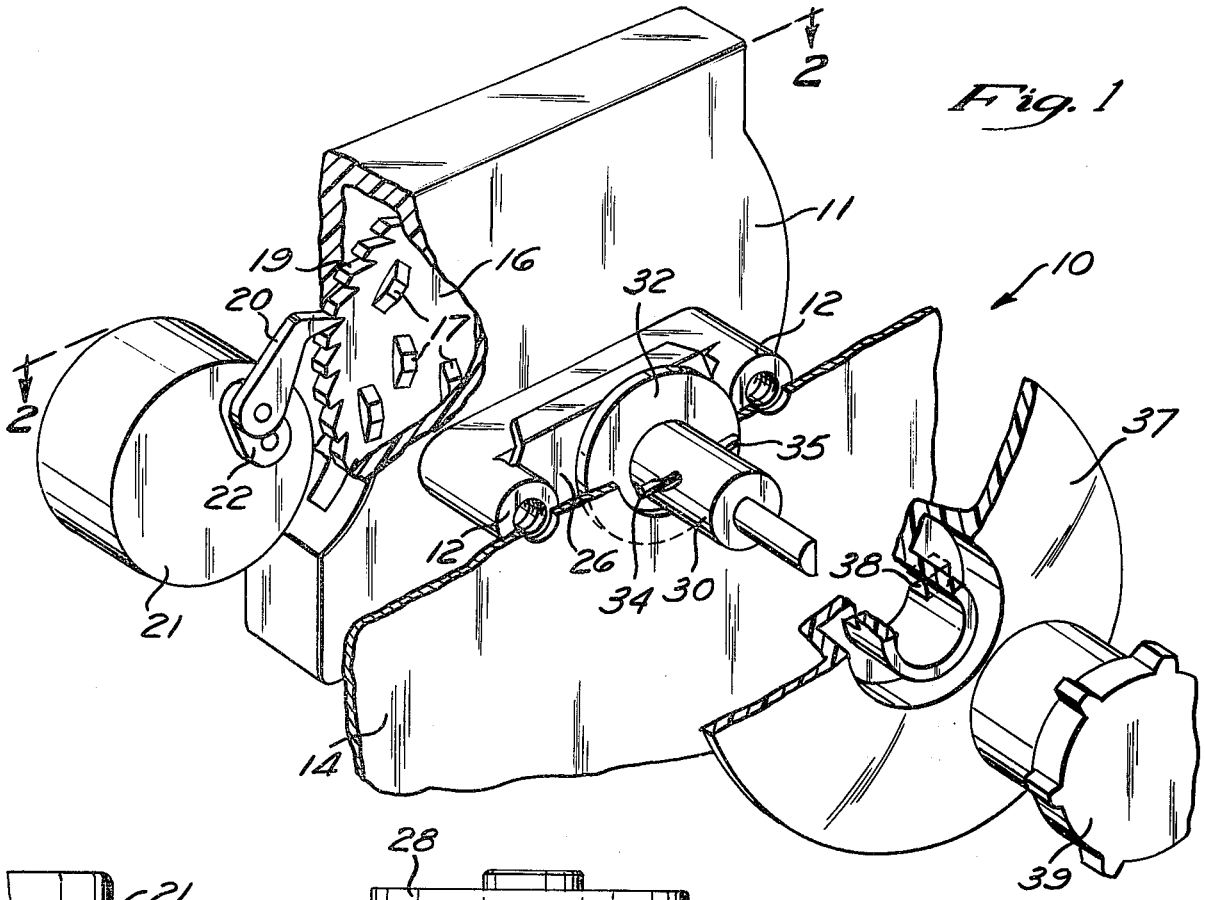
Fig. 1
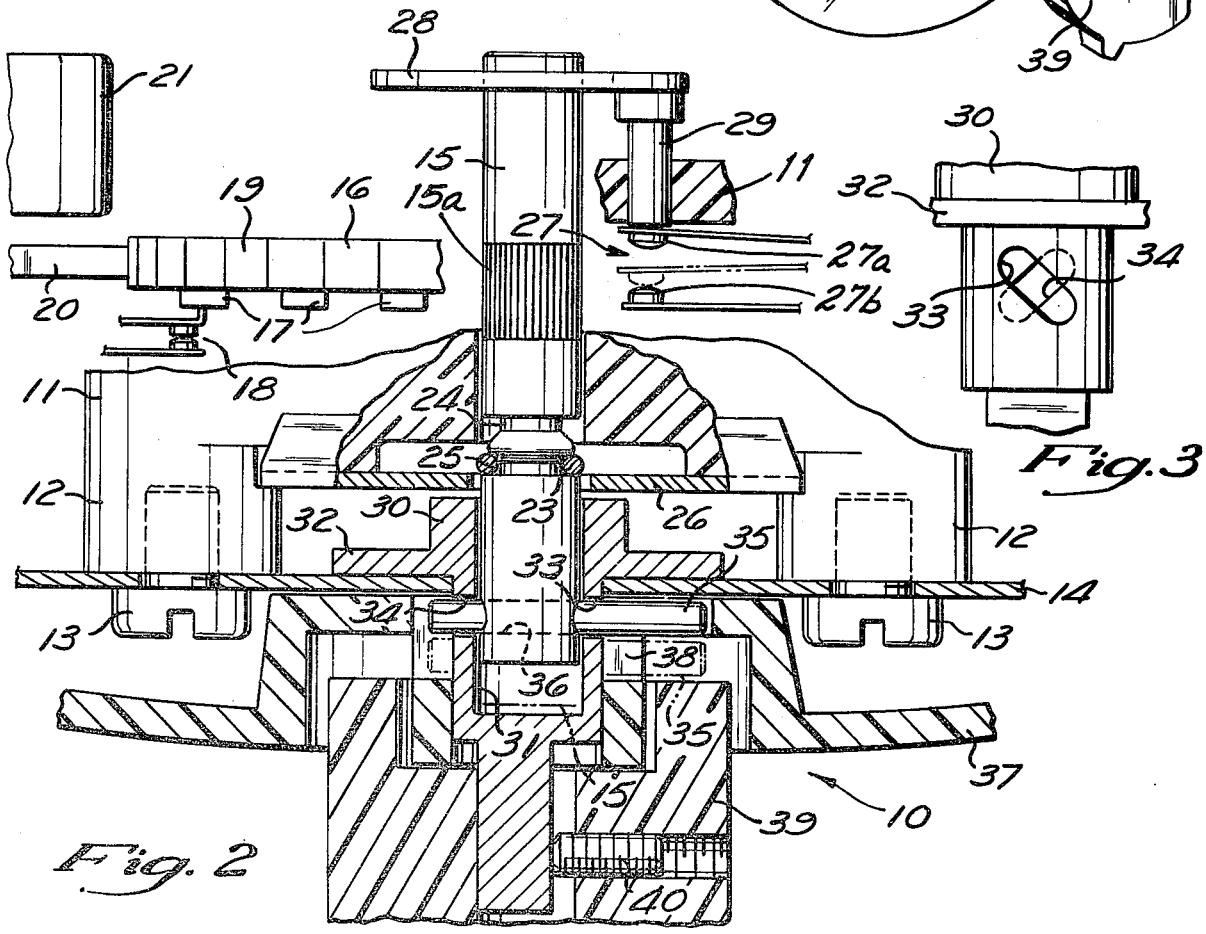
Fig. 3
Fig. 2

ROTATIONAL LINE SWITCH CONTROL

BACKGROUND OF THE INVENTION

This invention relates generally to sequential timers and, more particularly, to a switch control mechanism which ensures that the power to the control switches in the timer is off as the timer shaft is rotated to select a particular portion of the cycle.

Home laundry appliance timers employ a program cam or cam assembly which is rotated by a motor in one direction to close the proper combination of circuits at predetermined times and to open the same. Such circuits control the washing, extracting, rinsing, drying, and the like of a washing machine. Frequently, the operator desires to alter the prescribed program, and therefore the timer typically includes a manual knob for advancing the main timing cam. Some time after the invention of the automatic clothes washer, it became apparent to both the manufacturer and user of the equipment that damage to various components, including the program timer, could be caused by rapid rotation of the program timer shaft with the power connected to the timer and through it to various machine components. Most instruction books caution the user to turn the appliance off by proper indexing of the timer shaft (either "push to off" or "pull to off"), which disconnects a series switch in the timer, shutting power off to all control switches in the timer and thereby disconnecting power to other components of the machine. If these instructions are not followed, damage usually occurs to the program timer, and as a result of the program timer failure, other components can be damaged. The most common failure in the program timer is contact-welding, which is a result of switching high current through minimal air gaps and opposite voltage polarity during rapid rotation of the shaft.

Devices such as clutch knobs, positive stops, and timer shaft lock-up in the timer-energized position have been developed to protect the machine components and most have been effective. These devices, however, have been expensive or have had other undesirable operational characteristics.

One such fail-safe arrangement is set forth in U.S. Pat. No. 3,033,054. In that patent, the patentee provides a cam arrangement between a timer shaft and a timer shaft extension having a knob associated therewith so that, upon turning the knob, the timer shaft extension is cammed axially relative to the timer shaft to actuate a switch to open the timer circuit. However, since the timer shaft extension is axially movable relative to the fixed timer shaft, it is possible to override the safety feature by holding the knob outwardly relative to the timer shaft as the main cam is indexed to thus prevent operation of the cam and the opening of the circuit. Furthermore, the arrangement shown in the patent reauires a substantially redesigned timer, since the vast majority of timers have axially movable timer shafts which operate a switch for a "push to off"or "pull to off" safety feature.

SUMMARY OF THE INVENTION

This invention provides a sequential timer which ensures that the power to the timer switches is disconnected before the timer cam is moved by the control knob. This is accomplished by a cam arrangement between the control knob and an axially movable conventional timer shaft. More specifically, the timer shaft is capable of axial movement in one direction to open the timer circuit and is capable of axial movement in the other direction to close the circuit. The timer circuit includes a plurality of switches which are adapted to control a number of different timed operations. There is provided an extension on the timer shaft which is adapted to rotate the timer shaft in one direction and which has a socket at one end telescopingly receiving an end of the timer shaft. Rotation of the timer shaft in the other direction is prevented by the main timer cam since that cam is driven by a pawl, which engages ratchet teeth on the periphery of the cam. The pawl compels rotation in one direction, but prevents rotation in the other direction. Cam means are provided on the shaft extension for axially moving the shaft in its first direction upon initial rotation of the shaft extension to thereby axially shift the timer shaft and thereby open the circuit to the timer. After this initial rotation, further rotation causes the timer cam to open and close switches which are disconnected from the power source. The cam means includes diametrically opposed, helical slots through the socket of the timer shaft extension, and a pin extending through the slots and through an aperture in the end of the timer shaft. There is also provided means to prevent axial movement of the shaft extension so that the operator may not override the safety feature.

BRIEF DESCRIPTION OF THE DRAWING

FIG. 1 is an exploded, perspective view of a control mechanism according to this invention, with portions broken away for clarity;

FIG. 2 is a cross sectional view, the plane of the section being indicated by the line 2—2 in FIG. 1; and FIG. 3 is a fragmentary, elevational view of the cam arrangement according to the invention.

DETAILED DESCRIPTION OF THE INVENTION

Referring now to the drawings, there is illustrated a sequential timer 10. The timer 10 includes a housing 11 having mounting bosses 12 secured by screws 13 to a structural member 14 of an appliance. The timer 10 further includes a timer shaft 15 connected to a main timing cam 16 by a spline connection so that when the shaft 15 is manually rotated in a clockwise direction, as viewed in FIG. 1, the timing cam advances. The timing cam 16 has a plurality of arcuate, concentrically arranged, raised cams 17 which are adapted to sequentially engage switches designated at 18 and representative of any given number of switch contacts, which in turn complete circuits to the motor, pump, etc. of an automatic washer. Further details of such a cam wheel may be found in U.S. Pat. No. 2,703,347, the subject matter of which is incorporated herein by reference. The timer cam is provided with a plurality of ratchet teeth 19 around its periphery, and those teeth are sequentially engaged by a pawl 20 to drive the cam in a clockwise direction. Reverse rotation of the timing cam 16 is prevented by the engagement of the pawl. The pawl is driven by a synchronous motor 21 through an eccentric crank connection 22.

The shaft 15 is axially shiftable relative to the timer cam from its illustrated first position to a second position shown in dotted outline in FIG. 2. The timer shaft 15 is held in one of its two positions by a U-shaped detent spring 23, which is received within one of two annular grooves 24 or 25. The detent spring 23 is held captive by a clip 26, which, as may be seen in FIG. 2, is retained by notches cut into the bosses 12.

With the timer shaft 15 in its illustrated position, a switch 27, having contacts 27a, 27b, is biased to an open position and the switch 27 opens the circuit to the timer. There is provided a washer shaped element 28 which is attached to the timer shaft 15 and is adapted to push a plunger 29 inwardly when the timer shaft 15 is shifted to its phantom outline position in FIG. 2, with the detent spring 23 received within the groove 24. The plunger 29 is slidably mounted through the back wall of the housing 11. This action closes the switch 27 to supply power to the timer circuit.

The timer shaft 15 is axially shifted to open the timer circuit during rotation of the timer shaft to select a particular cycle, and this is accomplished in the following manner. There is provided a timer shaft extension 30 having a socket or recess 31 telescoped over one end of the timer shaft 15. Adjacent the end of the socket or recess, there is provided a radial flange 32 which bears against the structural member 14 of the appliance to thereby prevent axial movement of the timer shaft extension 30. Helical slots 33 and 34 are provided in the socket 31, and a pin 35 extends through an aperture 36 in the end of the timer shaft 15. In the position shown in the drawing, the switch 27 is open and rotation of the timer shaft extension 30 in a clockwise direction will cause the pin 35, and therefore the timer shaft, to rotate through the various cycles with the switch 27 open. When a particular setting has been reached, a slight counterclockwise movement of the timer shaft extension 30 causes the pin 35 to travel along the helical slots 33 and 34 to thereby draw the timer shaft 15 axially to its phantom outline position, to thereby close the switch 27 and energize the timer motor 21. The timer cam 16 is held against counterclockwise rotation by the pawl 20. If the timer shaft extension 30 is turned in a clockwise direction with the switch 27 closed, the helical slots 33 and 34 will shift the timer shaft 15 to open the switch prior to rotational movement of the timer shaft 15.

There is provided an indicator dial 37 which is keyed to the timer shaft 15 by the pin 35, which is retained in a slot 38. There is also provided a control knob 39 to rotate the timer shaft extension 30 and the knob 39 is fixed to the timer shaft extension 30 by a setscrew 40.

The invention is not restricted to the slavish imitation of each and every detail set forth above. Obviously, devices may be provided which change, eliminate, or add certain specific details without departing from the scope of the invention.

What is claimed is:

1. A control mechanism for a sequential timer, comprising an axially movable timer shaft adapted to open a circuit in a timer upon axial movement of said shaft in a first direction and to close said circuit upon axial movement of the shaft in a second direction, said circuit including a plurality of switches adapted to control a number of different timed operations, shaft extension means on said timer shaft for manually rotating said timer shaft in one direction, said switches being sequentially opened and closed upon manual rotation of said timer shaft, means to prevent rotation of the timer shaft in the other direction, cam means on said shaft extension means for axially moving said shaft in said first direction upon initial manual rotation of said shaft extension means in said one direction to thereby open said circuit and for then rotating the timer shaft in said one direction upon further manual rotation of said shaft extension means, so that said switches are sequentially opened and closed with the circuit open to prevent switch arcing and short pulsing of current, and means to prevent axial movement of said shaft extension.

2. A control mechanism according to claim 1, wherein said shaft extension has a socket at one end which telescopingly receives an end of the timer shaft.

3. A control mechanism according to claim 2, wherein said cam means includes diametrically opposed, helical slots through said socket and a pin extending through said slots and through an aperture in said end of said timer shaft.

4. A control mechanism according to claim 1, wherein said means to prevent rotation of the timer shaft in the other direction comprises a ratchet wheel splined to said timer shaft and a pawl engageable with said wheel and pivoted to a housing for said wheel.

5. A control mechanism according to claim 4, wherein at least one face of said wheel includes a plurality of concentrically and arcuately arranged raised cams and wherein said raised cams are adapted to sequentially engage said plurality of switches.

6. A control mechanism according to claim 4, wherein said timer shaft extends through said housing and is axially movable relative to said ratchet wheel.

7. A control mechanism according to claim 6, wherein said circuit is opened and closed by a plunger switch mounted on said housing which is engaged by actuator means on said timer shaft.

8. A control mechanism for a sequential timer comprising a housing, an axially movable timer shaft extending through said housing and adapted to open a circuit in a timer upon axial movement of said shaft in a first direction, and to close said circuit upon axial movement of the shaft in a second direction, said circuit including a plurality of switches adapted to control a number of different timed operations, a shaft extension for manually rotating said timer shaft in one direction and having a socket at one end which telescopically receives an end of the timer shaft, means to prevent rotation of the timer shaft in the other direction, said means to prevent rotation including a ratchet wheel within said housing splined to said timer shaft and a pawl engageable with said wheel and pivoted to said housing, at least one face of said wheel including a plurality of concentrically and arcuately arranged raised cams and wherein said raised cams adapted to sequentially engage said plurality of switches, cam means on said shaft extension for axially moving said shaft in said first direction upon initial manual rotation of said shaft extension in said one direction to thereby open said circuit, and for then manually rotating said timer shaft in said one direction upon further manual rotation of said shaft extension in said one direction to thereby open said circuit so that said switches are sequentially opened and closed with the circuit open, said cam means including diametrically opposed, helical slots through said socket and a pin extending through said slots and through an aperture in said end of said timer shaft, and means to prevent axial movement of said shaft extension.

* * * * *